US005531373A

United States Patent [19]

Eisman

[11] Patent Number: 5,531,373

[45] Date of Patent: Jul. 2, 1996

[54] FOOD CARTON AND FOLDING BLANK THEREFOR

[75] Inventor: Larry Eisman, Elkins Park, Pa.

[73] Assignee: Dopaco, Inc., Dowingtown, Pa.

[21] Appl. No.: 345,701

[22] Filed: Nov. 21, 1994

Related U.S. Application Data

[63] Continuation-in-part of Ser. No. 277,070, Jul. 19, 1994.

[51] Int. Cl.[6] ..... B65D 5/10

[52] U.S. Cl. ..... 229/108; 229/148

[58] Field of Search ..... 229/109, 114, 229/149, 190, 935, 198.2, 108, 148

[56] References Cited

U.S. PATENT DOCUMENTS

| | | | |
|---|---|---|---|
| D. 344,023 | 2/1994 | Eisman . | |
| D. 348,609 | 7/1994 | Eisman et al. . | |
| 1,995,053 | 3/1935 | Carruthers | 229/114 X |
| 2,156,250 | 4/1939 | Ziemmerman | 229/114 X |
| 3,633,815 | 1/1972 | Rosenburg, Jr. | 229/149 X |
| 4,054,241 | 10/1977 | Meyers et al. | 229/190 X |
| 4,448,309 | 5/1984 | Roccaforte et al. | 229/114 X |
| 4,534,505 | 8/1985 | Montealegre | 229/108 X |
| 4,620,666 | 11/1986 | Lacasa et al. . | |
| 4,718,595 | 1/1988 | Jones | 229/935 X |
| 4,809,808 | 3/1989 | Keefe et al. . | |
| 4,856,707 | 8/1989 | Lorenz . | |
| 4,877,178 | 10/1989 | Eisman . | |
| 4,951,865 | 8/1990 | Eisman . | |
| 4,984,734 | 1/1991 | Zion et al. | 229/109 |
| 5,037,026 | 8/1991 | Hanko . | |
| 5,118,032 | 6/1992 | Gebo . | |
| 5,160,081 | 11/1992 | Beales . | |
| 5,188,284 | 2/1993 | Eisman . | |
| 5,221,001 | 6/1993 | Eisman . | |
| 5,226,587 | 7/1993 | Eisman et al. . | |
| 5,249,736 | 10/1993 | Eisman . | |
| 5,323,956 | 6/1994 | Marcontell | 229/109 |
| 5,351,880 | 10/1994 | Goudreau | 229/109 X |

*Primary Examiner*—Allan N. Shoap
*Assistant Examiner*—Christopher J. McDonald
*Attorney, Agent, or Firm*—Dennison, Meserole, Pollack & Scheiner

[57] ABSTRACT

A blank and carton formed therefrom including a pentagon-shaped bottom panel, first, second and third side wall panels integral with three edges of the bottom panel with fold lines defined therealong, fourth and fifth side wall panels integral with opposed edges of the third side wall panel, a top panel integral with the outer edge of the third side wall panel opposed from the bottom panel along a defined fold line, and glue flaps on selected edges of the panels whereby upon a folding of the panels an erected receptacle with folding lid is formed.

13 Claims, 4 Drawing Sheets

FOOD CARTON AND FOLDING BLANK THEREFOR

This is a continuation-in-part of application Ser. No. 08/277,070, entitled Food Carton with Integral Cover, and filed Jul. 19, 1994.

BACKGROUND OF THE INVENTION

Cartons principally intended for use in the fast food industry are normally a one-use item and are commonly formed of relatively thin paperboard or cardboard folded from a blank or blanks.

When particularly bulky and/or heavy foodstuffs, such as pieces of chicken, are to be packaged, the carton will frequently be in the nature of a rather solid cardboard tub or pail with a removable lid wherein the necessary strength is provided by the thickness of the bucket wall.

In each instance, the goal is to properly accommodate the foodstuffs, and at the same time provide a product which, when considering the cost, the manner of assembly, and the ease of use, is economically feasible.

While folded paperboard cartons are not normally considered to have the strength of cylindrical bucket-type containers, they are considerably less expensive both with regard to materials and production. In order to enhance the strength of folded paperboard cartons, reliance heretofore has principally been placed on the use of thicker more expensive paperboard and the provision of larger size cartons than actually required by the foodstuffs to be stored therein. For example, the conventional rectangular carton is what might be considered a "universal" configuration even though the particular foodstuff involved might be round, as in hamburgers, pizza, and the like.

As a significant factor in providing an economically feasible carton, it is particularly important that the desired strength of the carton be maintained while minimizing waste in material and simplifying the apparatus and steps required in forming the blank.

SUMMARY OF THE INVENTION

The invention as set forth in the parent application constitutes a significant advance in fast food containers of the type wherein the cartons are formed from folded sheet material, normally cardboard or paperboard, and are so structurally configured as to provide a strength and structural integrity heretofore not available in such cartons.

The increased strength of the cartons of both the parent and present applications enables the use of a thinner less expensive sheet material. This is a significant factor in light of the throw-away nature of the carton and the fact that such cartons are produced in vast numbers whereby any per carton savings can ultimately involve substantial cost economy.

A particular and important aspect of the present invention is to provide a compact blank having a better production layout with a resultant saving of material and a simplification of the cutting apparatus. The carton blank, when formed in a conventional manner from a sheet of appropriate material, is laterally aligned and immediately adjacent an inverted duplicate blank with a single or common cut line between significant adjacent edge portions and with nesting end portions which minimize waste between the adjacent blanks. The common cut line simplifies the actual cutting of the adjacent blanks.

The increased strength of the carton of this invention, derived at least in part from the formation of the receptacle portion with three integrally joined walls, allows for containers of substantial depth, notwithstanding the use of relatively light and hence less expensive paperboard, thus accommodating products of greater bulk and weight.

Another aspect of the invention resides in the provision of carton locks and their positioning and relationship to the receptacle and lid components of the cartons to enhance the structural integrity of the cartons and accommodate themselves to the basic structural uniqueness of the blanks and cartons to in turn provide enhanced strength.

The blank of the invention, formed of conventional paperboard material with defined fold lines and cut lines, is of an elongate relatively narrow configuration with the opposed longitudinal end portions configured to closely nest with an adjacent duplicate blank reversed end for end. The central portion of the blank is configured whereby only a single cut line is required to define the adjacent edges of adjacent blanks at the central area thereof. The nesting and common cut line are significant in reducing material waste between adjacent blanks.

Each blank includes a bottom or bottom panel which, in the preferred and illustrated embodiment, is pentagonal with one side wall integral with one edge of the bottom and extending longitudinally therefrom to integral joiner with an enlarged pentagonal top or top panel. The one side wall has integral side walls extending from the opposed longitudinal edges thereof. The two side edges of the bottom generally opposed from the single side edge from which the first side wall extends, in turn each have an integrally joined side wall extending therefrom and having an appropriate glue flap or flaps. The top panel includes, integral with the peripheral edges other than for the edge integrally joined to the first side wall, lid or top panel walls, each co-extensive with a corresponding edge of the top, with appropriate glue flaps extending from selected ends of the lid walls.

In a preferred form of carton utilizing the features of the invention, the carton is of substantial depth and formed in the shape of a pentagon with five equal or substantial equal sides. Thus, notwithstanding the planar nature of the various panels folded from the paperboard blank, the container can be considered to assume what might broadly be described as a circular or encircling container, a configuration best adapted to provide enhanced strength and to accommodate multiple pieces of chicken and the like.

The receptacle portion of the carton has deep side walls rising from the base or bottom and flaring slightly outward. For maximum strength and integrity for the full height of the receptacle, three of these side walls are integrally joined along common side edges and with fold lines formed thereat. The side edges of the remaining two walls are appropriately sealed to each other and to the free edges of the first three walls utilizing overlapping glue flaps to form an enclosure with the upper edges of the receptacle walls defining a receptacle top edge in a pentagon configuration greater than that of the base.

The lid, which includes a pentagon-shaped planar top panel, has one linear edge thereof integrally formed along a common fold line with the center one of the three integral walls along the upper edge thereof for selective hinged closing of the lid over the receptacle. The top panel is dimensionally equal to or substantial equal to the pentagon configuration of the receptacle top edge and is provided with depending walls integral with the edges of the top panel other than for the hinged mounting edge. The lid walls flare slightly outward from the top panel and thus define a mouth greater than that defined by the upper receptacle edge for a smooth engagement over the upper portion of the receptacle as the lid is closed thereon. The flared nature of the lid walls provides for an effective guiding of the lid onto the receptacle. Further, as the lid walls are of a height substantially less than the height of the receptacle walls, the top panel of the lid sits directly on the upper edge of the receptacle with the corners defined by the receptacle walls nesting in intimate engagement with the corners formed by the lid walls. In this manner, the columnar structure at each corner of the receptacle is directly reinforced and stabilized both vertically and laterally by the lid thereover. Further, the entire periphery of the top panel of the lid is directly engaged with and supported by the upper receptacle edge to produce a high degree of rigidity and strength. It will also be recognized that the intimate engagement of the lid with the receptacle provides an effective seal for the retention of heat or to otherwise maintain the temperature of the goods within the carton.

The cartons also include lock assemblies with components on the receptacle immediately adjacent the upper edge thereof, and on the lid in or immediately adjacent the top panel thereof for a positive although releasable locking of the lid with the top panel firmly against the receptacle upper edge.

The lock assembly can include upwardly projecting anchor locks on two adjacent receptacle wall edges engaged through receiving slots or openings along corresponding edges of the top panel and retained therein by a pair of retainer flaps.

In an alternate embodiment, the lock assembly can include integral flanges on two of the upper receptacle wall edges folded inwardly and having laterally outwardly projecting tabs substantially in the plane of the receptacle upper edge and releasably engaging within a pair of transverse slots through the corresponding lid walls directly at the top panel with portions of the top panel defining projecting, slot-overlying flaps which correspond to, protect and guide the locking tabs.

A further variation of lock assembly comprises projecting reinforced lugs extending coplanar from one end of each of three receptacle walls immediately adjacent the upper edge of the receptacle and projecting beyond the respective adjacent receptacle walls. These lugs engage through corresponding slots provided in corresponding depending walls of the lid with each of the slots having an adjacent projecting lug guide and stabilizer.

These and other features and advantages of the invention will become apparent from the following more detailed description of the invention.

DESCRIPTION OF PREFERRED EMBODIMENT

Figure 1:
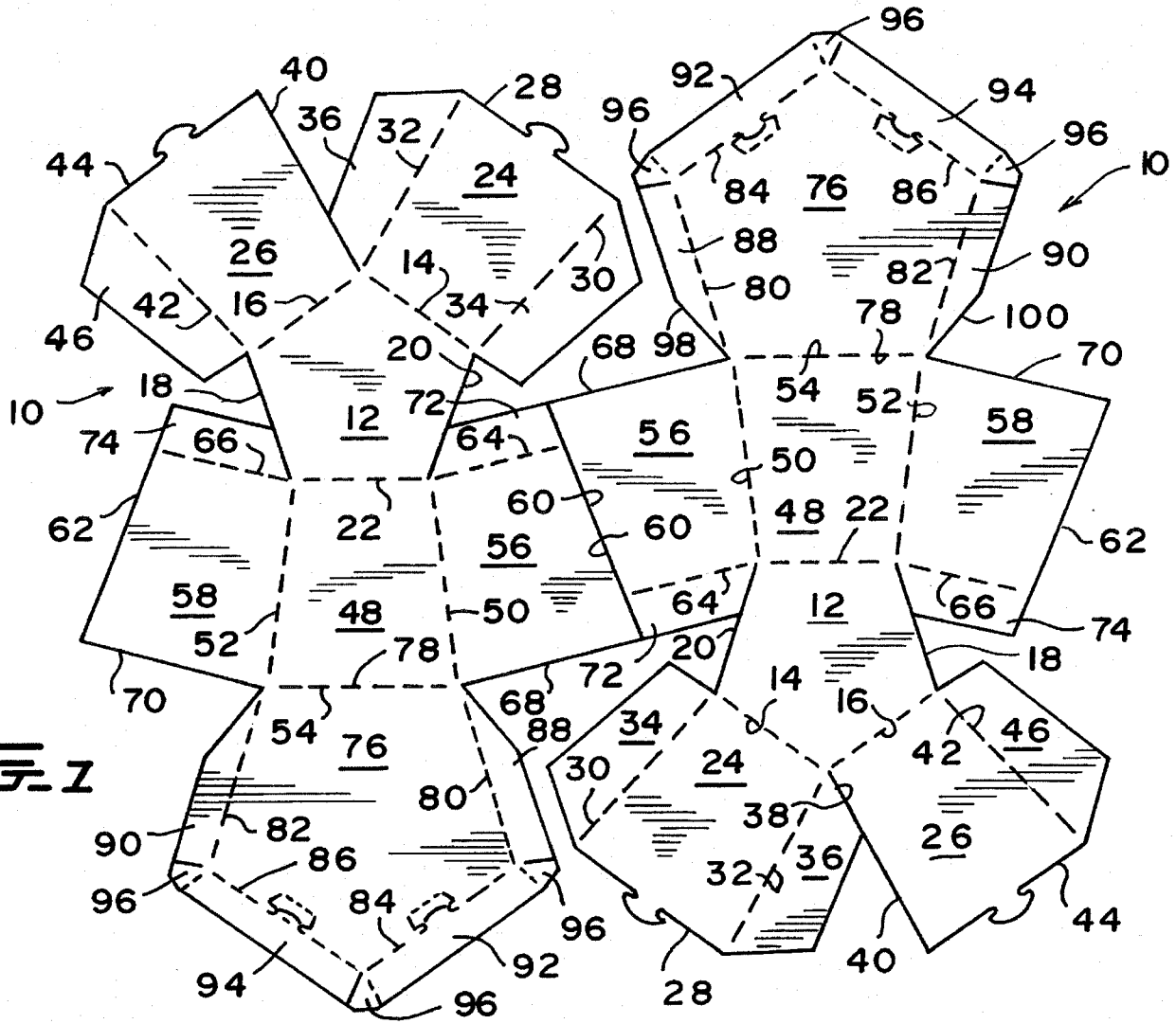
FIG. 1 is a plan view of two of the blanks of the invention, one rotated 180° relative to the other, and illustrating the layout and compact relationship of adjoining blanks as they are severed from a sheet or continuous strip of material.
Figure 3:
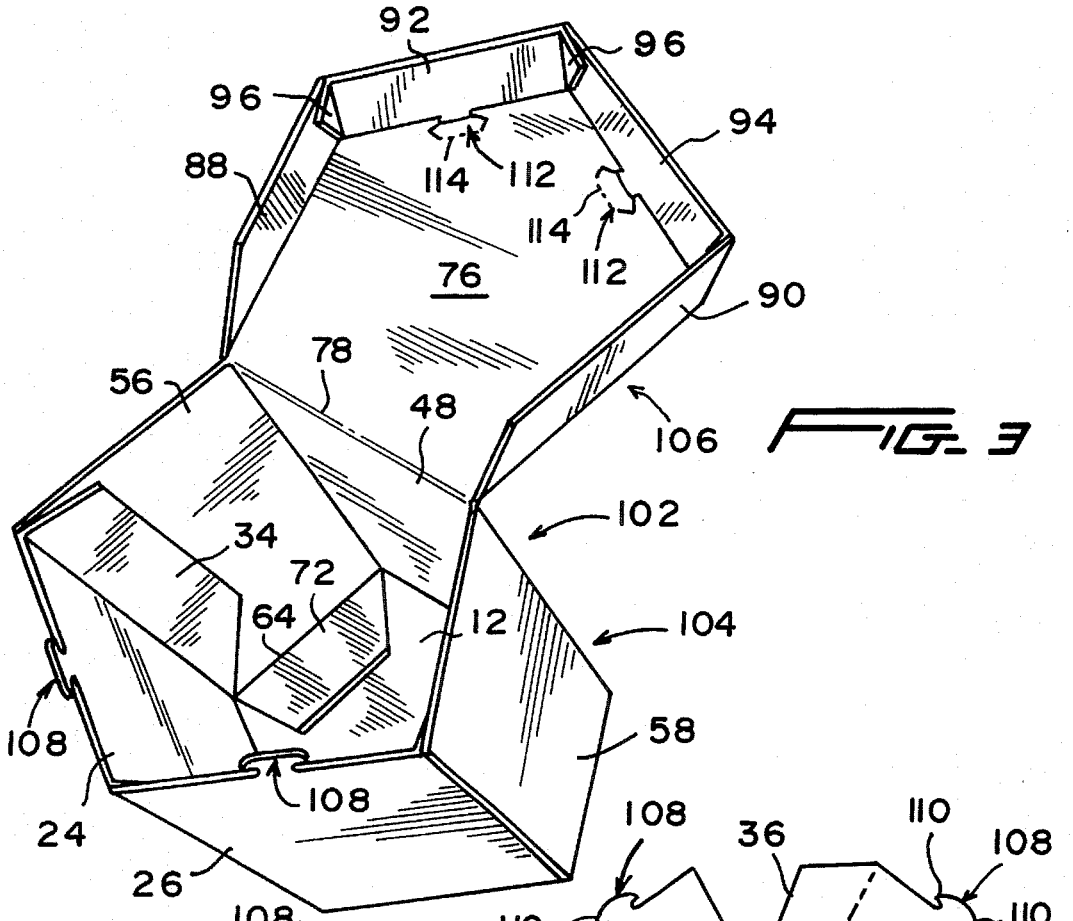
FIG. 3 is a top perspective view of an open carton formed from the blank of FIG. 2.
Figure 4:
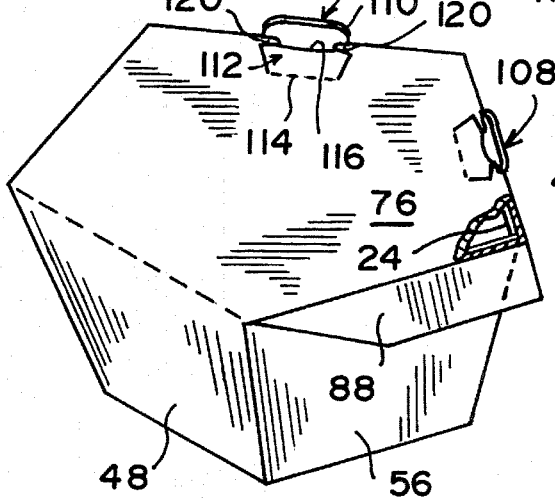
FIG. 4 is a top rear perspective view of the carton as it appears when closed, a portion being broken away to show the relationship between the lid and receptacle walls.
Figure 2:
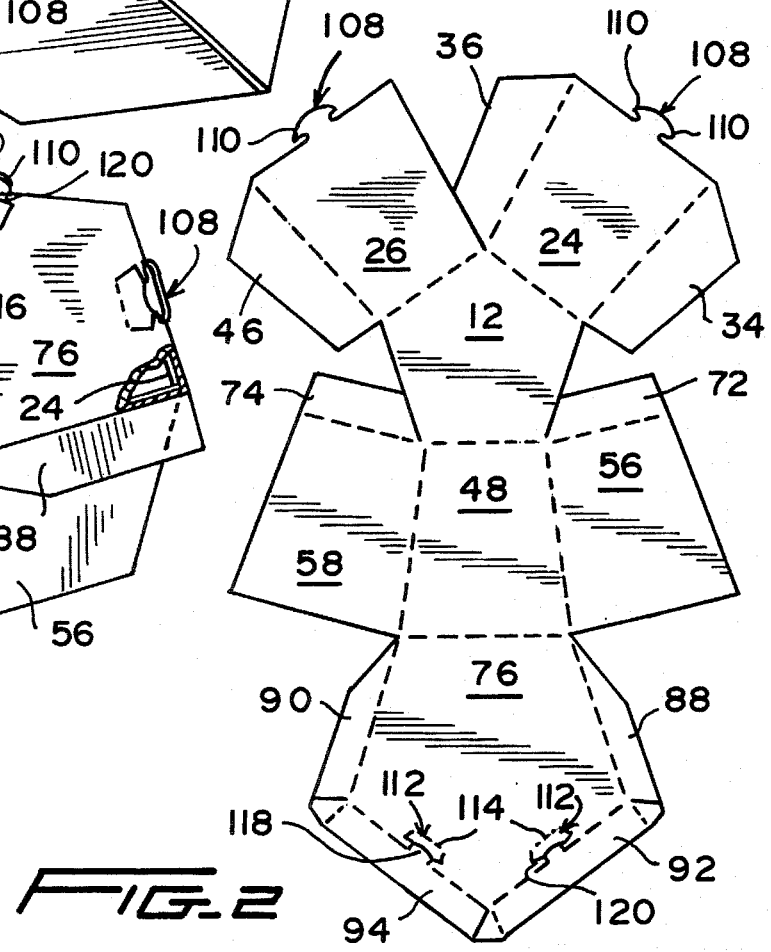
FIG. 2 is a plan view of a single blank with a first lock assembly incorporated therein.

Referring now more specifically to the drawings, and with particular reference to FIGS. 1, 2, 5 and 7, it will be noted that the blanks 10 therein are basically duplicates of each other, differing primarily only in incorporating different lock assemblies as shall be referred to subsequently. Like reference numerals will be used to designate like structure or components.

The blank 10 is formed as a single planar item from an appropriate sheet of foldable material capable of being self sustaining when erected into a complete carton. The preferred material will be paperboard of the type conventionally used in food containers. The material should be capable of resisting moisture at least to a limited degree, be easily formed into a carton, be relatively inexpensive, and in effect incorporate all of the desired attributes of a fast-food container.

The planar blank 10 includes a base or bottom panel 12 of pentagonal shape with five equal length edges, 14, 16, 18, 20 and 22. First and second side walls or side wall panels 24 and 26 are integral with adjacent bottom panel edges 14 and 16 along the respective lengths thereof. A separate fold line is defined along and co-extensive with each edge 14 and 16. The side wall panel 24 is configured as a trapezoid with an outer edge 28 parallel to and of greater length than the corresponding bottom panel edge 14. The side wall 24 also includes a pair of equal length laterally spaced side edges 30 and 32 which diverge laterally outward relative to each other from the bottom panel edge 14 to the outer wall panel edge 28 and defined therewith the configuration of the side wall panel 24.

A pair of edge glue flaps 34 and 36 are respectively integral with the side edges 30 and 32 of side wall panel 24 along the full length thereof. A corresponding fold line is defined along each of these edges 30 and 32 to enable an appropriate folding of the glue flaps 34 and 36 as the carton is erected. Both glue flaps are substantially narrower than the transverse width of the panel 24 therebetween. The glue flap 36, between the panels 24 and 26 which diverge from each other in light of the angular relationship between the adjacent bottom edges 14 and 16, has the opposed end edges thereof beveled to facilitate folding, and in the case of the inner end edge 38, accommodate the closely spaced adjacent side edge 40 of the adjacent side wall panel 26. The glue flap 34 will similarly have beveled outer end edges to avoid longitudinal projection of the glue flap in the erected carton.

The side wall panel 26 is of the same size and configuration as the panel 24, and similarly includes a second side edge 42, and an inner edge integral with the bottom panel edge 16 with a fold line defined therealong, and a relatively longer outer edge 44 paralleling the inner edge or bottom panel edge 16.

A glue flap 46, of generally equal size with glue flaps 34 and 36, is integral with and extends laterally from the panel edge 42, with a fold line extending along the length of the edge 42. The glue flap 46 also preferably has opposed beveled end edges.

A third side wall or side wall panel 48 is integral and co-extensive with the bottom panel edge 22 positioned diametrically opposed from the juncture between the bottom panel edges 14 and 16. An appropriate fold line is defined between the bottom panel 12 and third side wall panel 48 along the edge 22 for a folding of the panel 48 relative to the bottom panel 12 as the blank is formed into a carton.

The third side wall panel 48 includes a pair of laterally spaced side edges 50 and 52 diverging slightly relative to each other outward from the opposed ends of the edge 22 and interconnected, at the outer ends thereof, by an outer end edge 54.

Fourth and fifth side walls or side wall panels 56 and 58 are integrally joined to the third panel 48 respectively along the side edges 50 and 52. Fold lines are defined along an co-extensive with the edges 50 and 52 for a folding of the fourth and fifth panels 56 and 58 relative to the panel 48. The panels 56 and 58 include outer edges 60 and 62 respectively laterally spaced from the fold line edges 50 and 52 and diverge respectively therefrom from respective inner or base edges 64 and 66 to respective parallel free outer edges 68 and 70. The panels 48, 56 and 58, thus defined, are of the same configuration and size as the first and second panels 24 and 26.

The inner edges 64 and 66 extend from the opposite ends of the edge 22, joining bottom panel 12 and panel 48, at an angle thereto determined by the angles of the panel edges 50 and 52. Each of these bottom or inner end edges 64 and 66 has a glue flap 72 and 74 respectively integral therewith, with a fold line defined along each edge 64 and 66 for an inward folding of the respective glue flaps 72 and 74 relative to the corresponding side wall panels 56 and 58. As will be noted from the drawings, the lateral inner side edge of each glue flap 72 and 74 is beveled to correspond with the edges 20 and 18 of the bottom panel 12 for the height of the glue flap for definition of the beveled end edges of the glue flaps and the corresponding panel side edges 20 and 18 by a common severance or parting line. The outer end edge of each of the glue flaps 72 and 74 comprises a free edge continuation of the respective outer panel side edges 60 and 62.

Thus formed, and noting FIG. 1 in particular, adjacent rotated blanks, for the height thereof defined by the panels 56 and 58, can be defined by a common severance line or cut line to both reduce scrap and simplify the cutting apparatus required.

A top panel 76, of a configuration similar to that of the bottom panel 12, preferably pentagonal, includes an inner edge 78 coincident with the outer edge 54 of the third side wall panel 48 and of equal length therewith, with a fold line defined therealong. The remaining four side edges 80, 82, 84 and 86 are of equal length with the top panel edge 78 and correspond in length to the outer edges 28, 44, 68 and 70 of the side wall panels 24, 26, 56 and 58.

Lid walls or wall panels 88, 90, 92 and 94 are integral with the respective top panel edges 80, 82, 84 and 86, with appropriate fold lines defined therealong. The outermost lid wall panels 92 and 94, those directly opposed from the inner edge 78 of the panel 76, include appropriate glue flaps 96 integral with selected end edges thereof, and with fold lines defined therebetween. It is preferred that two glue flaps 96 be formed respectively at the opposite ends of the lid panel 92, and one glue flap 96 at the end of the lid panel 94 adjacent the corresponding end of the lid wall panel 90. The glue flaps 96, of a generally triangular configuration, have the free lateral side edges thereof formed by a common cut or severance line with the adjacent end edges of the adjacent lid wall panels. The inner end edges of the lid side wall panels 88 and 90 are sharply beveled, as at 98 and 100 respectively to, in the erected carton, simplify lid alignment and closure.

As will be best appreciated from FIG. 1, the top panel 76 and associated lid wall panels are of a transverse width less then that of the combined side wall panels 24 and 26 with the associated glue flaps 34 and 46. Such an arrangement allows for a nesting of the adjacent inverted or rotated blanks which, with the common central severance line along the common edges 60 of the adjacent blanks, reduces waste to a minimum.

The uniquely defined blank 10, noting FIGS. 3, 4, 6 and 8, erects into a carton 102, including an upwardly opening receptacle 104 and a pivotally mounted integral lid 106.

The lid wall panels 88–94 extend laterally from the top panel 76, diverging slightly outward relative to each other and secured by the overlapping glue flaps 96 bonded to adjacent ones of the lid wall panels.

The side walls or side wall panels 24, 26, 48, 56 and 58, extend upwardly from the bottom panel 12, diverging slightly relative to each other and being fixed in a side by side relation to each other both by integral joinder and by the side wall glue flaps 34, 36 and 46. The adjoined side walls are in turn secured to the bottom panel 12 by the bottom glue flaps 72 and 74, thus completing the lidded carton. Noting FIG. 4 in particular, it will be appreciated that the top panel 76 is substantially co-extensive with the top edge of the defined receptacle 104 and seats directly on this top or upper edge for enhanced stacking strength. Each of the vertical corners of the receptacle 104, outward of the rear or lid joined wall panel 48, is closely nested within a corresponding lid corner for greater structural integrity and resistance to both lateral and vertical loads.

The invention also contemplates incorporating integral releasable lock assemblies for the cartons which will maintain and enhance the relationship between the lid and the receptacle. These will be described principally in terms of the erected cartons with the parts of the cartons designated by the reference numerals designating like parts of the blank. In one embodiment as illustrated in FIGS. 1–4, the upper edge of each of the receptacle front walls 24 and 26 at an intermediate point therealong, includes a coplanar upwardly extending anchor lock 108. Each anchor lock 108 includes a transversely elongate head integrally joined to the upper edge of the corresponding front wall by a relatively narrower neck or neck portion. The head defines a pair of locking lobes 110, one to each side thereof.

The top panel 76 of the lid 106 includes, in alignment with each anchor lock 108, a retaining flap 112 integrally hinged along an inner edge 114 thereof parallel to the corresponding front edge from which a corresponding front lid wall 92 or 94 depends. Other than for the hinged inner edge 114, each flap is severable from the top panel 76 for hinged movement relative thereto out of the plane of the top panel 76 as shall be described subsequently. The inherent flexible resiliency of the material of the top panel and flaps, notwithstanding the hinge line defined along edge 114, is such as to tend to maintain the retaining flaps 112 within the plane of the top panel 76 even if temporarily moved therefrom as by an insertion of an anchor lock 108.

The opposed free side edges of each retaining flap diverge forwardly or outwardly from the opposed ends of the hinged inner edge 114 to define a maximum flap width slightly greater than that of the head of an anchor lock. The front or outer edge of each retaining flap 112 includes an elongate concave central portion 116 which defines a central elongate generally arcuate guide aperture or recess. This recess is further defined by and forwardly bordered by an elongate upwardly convex guide flange 118 which forms a coplanar upward extension of the corresponding lid front wall 92, 94.

The front or outer edge of each retaining flap, longitudinally beyond the concave central portion 116, includes two linear end portions angled slightly inward and forming a pair of opposed support shoulder 120 on the lid top panel 76, one to each side of the corresponding formed guide recess and spaced to receive the corresponding anchor lock neck and not the head. In addition, each of these angled linear end portions defines a forwardly directed pressure point to engage against a received anchor.

In closing the carton, the downward and outward flaring of the lid front walls 92, 94 is such as to automatically receive the upwardly projecting anchor locks 108 inward thereof and, at least toward the upper edges thereof, in sliding engagement with the inner faces of these lid front walls for a direct guiding thereof to the aligned overlying guide recesses which are of a length so as to receive the central portions of the upper edges of the anchor lock heads therein. Continued downward movement of the lid, or corresponding upward movement of the anchor locks, which are stabilized by the projecting guide flanges 118 on the lid front walls, causes an upward flexing of the retaining flaps 112 about the hinged inner edges 114 thereof. The inner edges of the shoulders 120 in turn slightly flex the respective anchor locks inwardly or rearwardly until such time as the head moves above the top panel shoulders 120. At that point, the lobes, through the inherent resilient flexibility thereof, spring forwardly and into overlying relation to the shoulders 120 with the necks of the anchor locks nesting between the inner ends of the shoulders and against the forward guide flanges 118. So positioned, the retaining flaps 112, again through the inherent flexible resiliency thereof, tend to drop downwardly toward the plane of the lid top panel 76 with the pressure points of each retaining flap engaging against the inner face of the corresponding anchor lock 108, generally at or adjacent the opposed edges of the anchor lock neck. Each anchor lock is thus releasably fixed in position with the head lobes 110 engaged over the shoulders 120 which prevent withdrawal of the anchor locks and opening of the lid. So engaged, and as previously describe, the lid top panel 76 will seat in a sealed relation on the upper edge of the receptacle 104.

While the lid, as above described, is positively locked in a closed position, and will be retained regardless of the position of the carton, even if inverted, release of the lid is easily effected. Basically, in order to release the lid, each of the retaining flaps is, by finger pressure, moved downwardly relative to the lid top panel with the corresponding anchor lock flexed slightly inward to move the head lobes inward of the shoulders. At that point, the lid can be easily raised from the receptacle. This can be effected by a slight downward push on the anchor locks as the lid is raised. As an alternate means of opening the lid in a simple and straight forward manner, the anchor locks can be merely flexed inwardly away from the shoulders and slightly downward. This in turn will effect a corresponding downward pivoting of the retaining flaps and a simple sliding of the anchor locks downwardly away from the upwardly moving lid.

Figure 6:
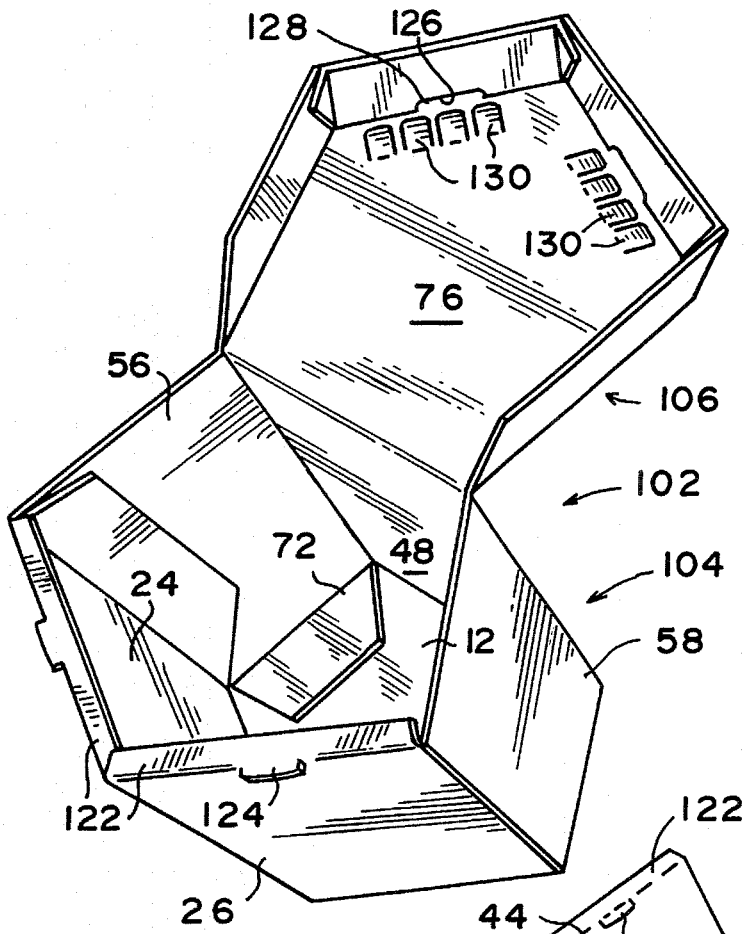
FIG. 6 is a top perspective view of a carton formed from the blank of FIG. 5.
Figure 5:
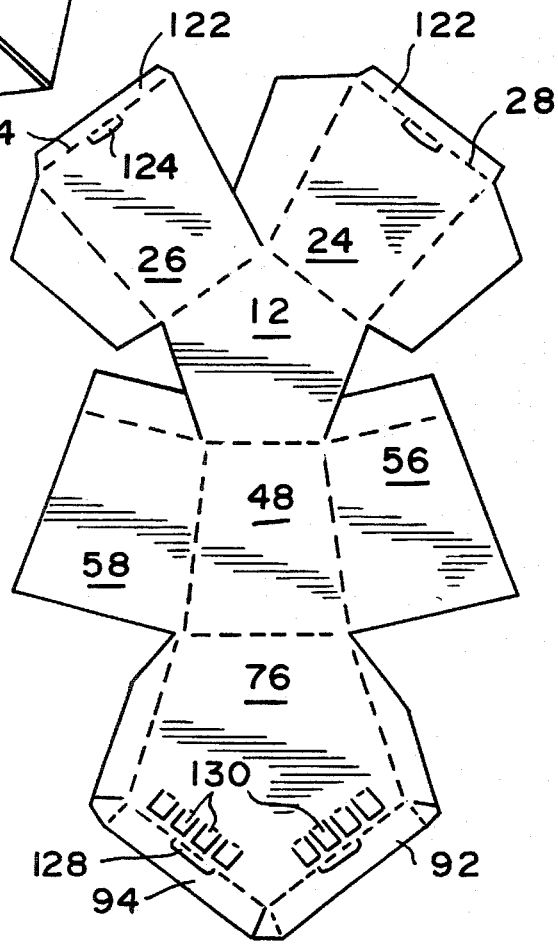
FIG. 5 is a plan view of the blank with a second integral lock assembly incorporated therein.

With reference to FIGS. 5 and 6, the same basic carton 102 is presented with a modified lock assembly.

In this embodiment, a pair of elongate flanges 122 are respectively co-extensive with the upper or outer edges 28 and 44 of the first and second receptacle walls 24 and 26, and integral therewith along fold lines defining a hinge joinder for an inward folding of the flanges 122 relative to the corresponding walls 24 and 26. The fold line for each flange 122 is interrupted along an elongate portion whereat the lower or inner longitudinal edge of the flange includes an integral coplanar tab or tongue 124 cut or substantially severed from the upper or outer edge portion of the corresponding receptacle front wall 24 or 26. Thus, upon an inward folding of the flange, the corresponding tab will swing upwardly and outwardly therewith to project forwardly from the corresponding wall, leaving a corresponding elongate recess immediately therebeneath while retaining a continuous upper edge bearing surface thereover. The flanges 122 are narrow and provide substantially no restriction to the introduction and removal of foodstuffs. It will also be appreciated that the flanges can easily be folded to a locking position subsequent to the introduction of the foodstuff and can, subsequently, be returned to a position coplanar with the walls when the foodstuff is to be retrieved.

The locking assembly is completed by the provision of a retaining slot 126 for each of the tabs 124. The slots 126 are defined, respectively, along a portion of the two lid front walls to align with and receive the tabs upon a closing of the lid and a bringing of the top panel 76 of the lid into sealing engagement with the upper periphery of the receptacle 104, now defined by the respective receptacle wall upper edges and the two flanges 122.

Each of the slots 126 is defined by a tab 128 coplanar with the top panel 76 and cut from the corresponding lid front wall at and immediately below the fold line defined between that lid front wall and the top panel. The lid tabs 128 extend forwardly from the top panel into overlying relation to the formed slot and the corresponding lid front wall. Thus, the lid tabs, not only define the recesses 126 upon formation of the lid 106, but also provide an overlying guide to the introduction of the receptacle tabs to ensure an outwardly directed positioning thereof whereby a positive interlock is achieved. The lid tabs also provide a protective overlay for the locking tabs, reducing the possibility of accidental release.

In securing the lock assemblies of FIG. 5 and 6, the receptacle tabs engage the inner surfaces of the lid front walls as the lid is closed over the receptacle with the tabs, and/or the flanged upper portions of the receptacle front walls, and/or the lid front walls flexing slightly until the tabs align with the lid slots. At that point, the resiliency of the material of the carton results in an outward snapping of the receptacle tabs through the lid slots for a locking of the lid to the receptacle. At the point of locking, the entire peripheral upper edge of the receptacle intimately engages against the undersurface of the top panel 76 of the lid for a peripheral seal thereabout.

The receptacle flanges 122, in the closed carton, will immediately underlie and extend in face to face engagement with the inner surface of the overlying lid top panel 76 for a minor width thereof inward from the respective receptacle front walls 24 or 26.

As a means for indicating the contents of this carton, a series of laterally spaced push-flaps 130 can be aligned across the lid top panel 76 parallel to one or both of the lid front walls 92 and 94. Each push-flap is integrally joined to the top panel 76 along an inner fold or hinge line laterally inward of the inner edge of the corresponding folded receptacle flange in the closed carton. Each of these flaps is pivotally moveable relative to the top panel with each of these flap 130 extending forwardly from the corresponding fold line into at least partially overlying relation to the corresponding flange 122. This relationship is particularly significant in that the designated push flap, upon downward pressure thereon, will downwardly flex the underlying flange and snap therebeneath. In this manner, the content indicating flap is retained in its indicating position against any possibility of accidental return to its initial position. Appropriate indicia will of course be associated with each of the flaps as an indication of the carton contents.

Figure 8:
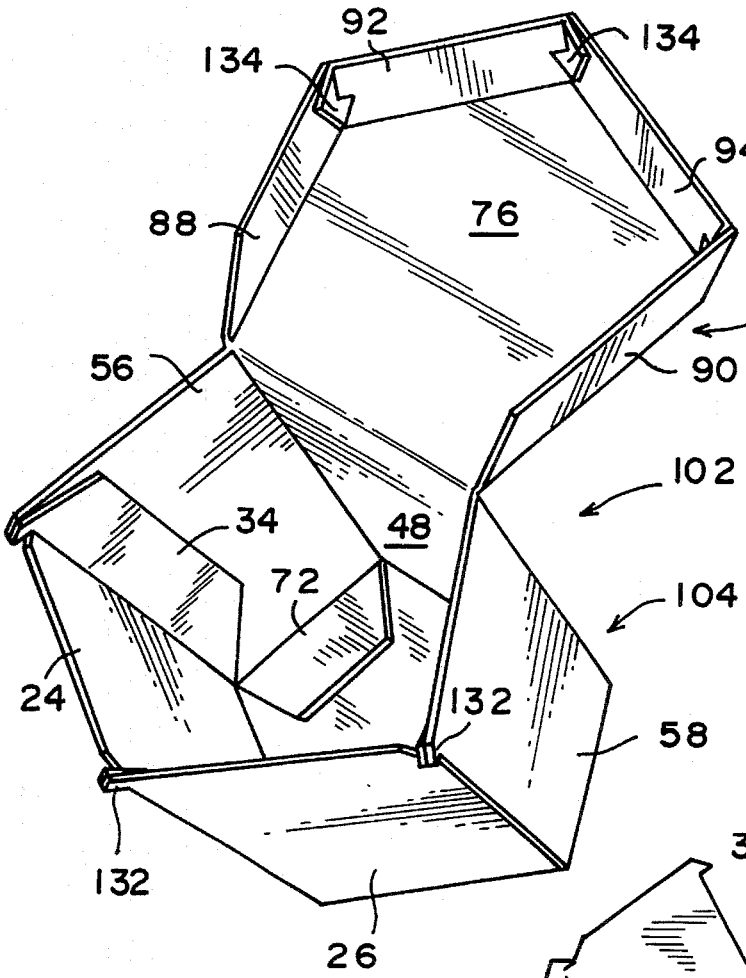
FIG. 8 is a top perspective view of a carton formed from the blank of FIG. 7.
Figure 7:
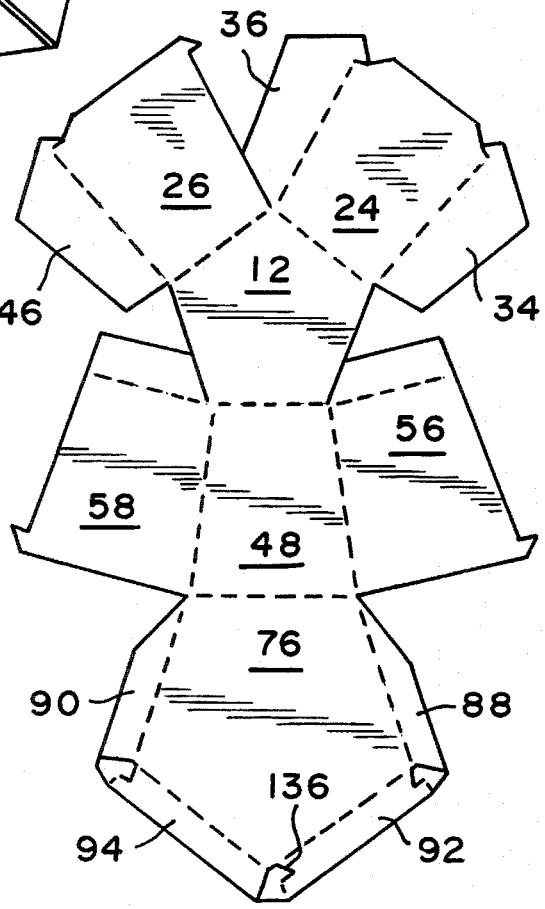
FIG. 7 is a plan view of the blank with a third form of lock assembly integrally defined therewith.

Another embodiment of the invention is illustrated in FIGS. 7 and 8. In this embodiment, the lock assemblies are defined by forwardly projecting locking lugs 132 on each of the formed corners of the receptacle 104 forward of the rear receptacle wall 48 to which the lid top panel 76 is integrally hinged. These lugs 132 are defined at the coplanar upper edges of the erected receptacle walls 24, 26, 56 and 58, with the upper edges of the projecting lugs defining coplanar continuations of the upper edges of the receptacle walls whereby the desired seal of the receptacle edge to the top panel is maintained. The lock assembly is completed by slots 134 defined through the lid front walls 92 and 94 at the corners thereof and aligned with the respective lock lugs 132.

Referring now specifically to the lug locks 132, it will be noted that two of these lug locks project coplanar with and forward from the forward corner-defining edges of the receptacle side walls 56 and 58 with each of these lugs being of double thickness and defined from adhesively bonded overlying flaps formed as respective coplanar extensions of each side wall and the corresponding glue flap bonded to the inner face thereof. The center lug is coplanar with one of the receptacle front walls 26 and, at the front corner between the front walls, extends forwardly beyond the second front wall. This forwardmost lug is similarly defined from a pair of adhesively bonded overlying flaps, one coplanar with the corresponding front wall 26 and the other integral and coplanar with the glue flap 36 which is integrally formed with and folded from the receptacle front wall 24 beyond which the forwardmost lug projects.

The lug-receiving slots are positioned to receive the lugs as the lid closes with the lid top panel fully seating on the upper peripheral edges of the receptacle walls and formed lugs. In this manner, the significant lid-to-receptacle seal is also maintained in this embodiment.

Each of the slots 134 has a stabilizing reinforcing lug or flap 136 projecting therebeyond and positioned to parallel and lie immediately outward of a respective locking lug received through the slot as a guiding and rigidifying means for the locking lug as well as a means for protecting the engaged locking lug against accidental retraction or distortion.

Each of these reinforcing lugs 136 is defined from the adjacent lid wall and is a coplanar extension of an adjacent angularly directed glue flap whereby upon a folding of the glue flap from the wall through which a locking slot is defined, the locking slot will automatically be formed. Similarly, the reinforcing lug will be brought into a position paralleling and projecting forwardly from the lid wall adjacent the wall within which the corresponding locking slot is defined.

The foregoing described embodiments are illustrative of the invention, and as other embodiments incorporating the inventive features may occur to those skilled in the art, the disclosed embodiments are not to be considered as limitations on the scope of the invention. Rather, the invention is to be limited only by the scope of the claims following hereinafter.

I claim:

1. In the formation of a covered carton, a first planar bottom panel with a periphery defined by five equal length edges, first, second and third side walls respectively integrally joined to three of said edges along fold lines and projecting outwardly therefrom, said three side walls each being of a progressive greater width outward from said bottom panel to a respective outer edge, said first and second side walls having opposed side edges and projecting outward from first and second adjacent ones of said bottom panel edges, said third side wall projecting outward from a third one of said bottom panel edges spaced from said first and second adjacent bottom panel edges by fourth and fifth ones of said bottom panel edges, said third side wall having opposed side edges, fourth and fifth side walls positioned laterally adjacent and integral with said third side wall respectively along said opposed side edges thereof and independent of said bottom panel edges, a corresponding fold line defined along each of said opposed side edges of said third side wall, said fourth and fifth side walls being of substantially the same size as said third side wall, said fourth and fifth side walls each having an outer side edge laterally outward of said third side wall, side glue flaps integral with selected ones of said side wall edges along fold lines for engagement with adjacent side walls, a top panel with equal length edges and defining a periphery of the same configuration as that of said bottom panel, said top panel edges being of greater length than said bottom panel edges, said third bottom panel side wall having the outer edge thereof integrally joined to one of the top panel edges along the length thereof, and top panel walls projecting outward from said top panel edges other than the top panel edge integrally joined to said third bottom panel side wall, said top panel walls having opposed end edges with glue flaps integral with selected ones of these end edges for securement to adjacent top panel walls.

2. The structure of claim 1 wherein said fourth and fifth side walls each have a base edge extending laterally outward of the respective opposed side edges of said third side wall in general alignment with said third one of said bottom panel edges from which said third side wall projects, and an integral base glue flap joined to each of said fourth and fifth side walls along said base edge thereof and foldable relative thereto for overlying engagement with said bottom panel.

3. The structure of claim 2 wherein said first and second side walls each have the opposed side edges thereof diverging slightly relative to each other, said side glue flaps being integral with said opposed edges of said first side wall and with one of said opposed edges of said second side wall for selective folding relative thereto for engagement with adjacent side walls.

4. The structure of claim 3 including lock means on said first and second side walls adjacent the respective outer edges thereof, and cooperating lock means on said top panel adjacent the corresponding top panel edges thereof.

5. For use in the formation of a folded covered carton, a planar blank of foldable material, said blank including a bottom panel with a periphery defined by angularly related straight edges, first, second and third side wall panels respectively integrally joined to three of said edges along fold lines and projecting outwardly coplanar therefrom, said first and second wall panels having opposed side edges and projecting outward from first and second adjacent ones of said bottom panel edges, said third side wall panel projecting outward from a third one of said bottom panel edges spaced from said first and second adjacent bottom panel edges by intermediate ones of said bottom panel edges, said third side wall panel having opposed side edges, fourth and fifth side wall panels positioned laterally, coplanar, adjacent and integral with said third side wall panel respectively along said opposed side edges thereof with corresponding fold lines defined along each of said side edges of said third side wall panel, said fourth and fifth side wall panels being of the same size as said third side wall panel, said fourth and fifth side wall panels each having a side edge laterally outward of said third side wall panel, glue flaps coplanar and integral with selected ones of said side edges of said side wall panels along fold lines, a top panel with edges defining a periphery of the same configuration as that of said bottom panel, said third bottom panel side wall panel having an outer edge integrally joined to one of said top panel edges along the length thereof, and top panel walls projecting outward from said top panel edges other than said top panel edge integrally joined to said third bottom panel side wall panel, said top panel walls having opposed end edges with glue flaps integral with selected ones of these end edges.

6. The blank of claim 5 wherein said bottom panel and said top panel are each of a pentagonal configuration, said top panel edges being of greater length than the corresponding ones of said bottom panel edges.

7. The blank of claim 6 wherein said bottom panel intermediate edges are free edges.

8. The blank of claim 7 wherein said bottom panel edges are of equal length, and said top panel edges are of equal length.

9. A pattern layout for folding blanks for cartons comprising a planar sheet of material, first and second planar duplicate blanks defined from said sheet, said second blank being inverted relative to said first blank, both end-for-end and side-for-side, each blank including a bottom panel with first and second side panels diverging outward relative to each other from said bottom panel and defining a first end portion of said blank, a third side panel extending from said bottom panel generally diametrically opposed from said first and second side panels, fourth and fifth side panels extending laterally from opposite sides of said third side panel and combining therewith to define a central area of said blank, and a top panel extending from said third side panel generally diametrically opposed from said bottom panel and defining a second end portion of said blank, said fourth side panel having an elongate outer edge with said adjacent blanks defined with said fourth side panel outer edges co-extensive for definition by a single severance line through said sheet, said first end portion of each of said adjacent blanks partially nesting between said fourth side panel and second end portion of the adjacent inverted blank for minimization of scrap between said blanks.

10. A closable carton for foodstuffs and the like formed from a unitary blank, said carton comprising an upwardly opening receptacle and a lid for said receptacle selectively pivotable to a closed position over said receptacle; said receptacle including a bottom panel with peripheral edges and with peripheral receptacle walls of a predetermined height joined to said bottom panel and extending upward relative to respective ones of said bottom panel edges, selected ones of said receptacle walls being integral with said bottom panel, and glue flaps on other selected ones of said receptacle walls overlying and bonded to said bottom panel and securing said other selected ones of said receptacle walls to said bottom panel, said receptacle walls terminating in upper edges in a common plane, said receptacle walls having joined side edges defining angular corners and forming an enclosure; said lid including a top panel dimensionally greater than said bottom panel and with peripheral edges defining a periphery and corresponding to the peripheral edges of said bottom panel, said top panel including an inner face adapted for engagement on said receptacle wall upper edges peripherally about said receptacle for a direct support of said top panel by said receptacle walls, said lid including lid walls corresponding to respective receptacle walls and of a lesser height than said receptacle walls, said lid walls having edges foldably joined to at least a majority of said top panel edges and extending laterally inward from said inner face of said top panel and terminating in free edges wherein said lid walls, with said lid in said closed position, overlie the corresponding receptacle walls laterally outward thereof with said outer edges of said lid walls terminating in spaced relation upward of said receptacle bottom panel.

11. The carton of claim 10 wherein said receptacle and said lid are of a pentagonal configuration with said receptacle walls comprising a back wall, two side walls diverging outwardly from the opposite side edges of said back wall and defining corners therewith, and two front walls forming corners with and converging forwardly from said side walls and further defining a forward corner, the upper edge of said back wall, and one of said top panel edges being integrally joined with a hinge-providing fold line defined therealong, said receptacle walls flaring outward from said bottom panel and defining an upper periphery substantially co-extensive with the periphery of said lid top panel for nesting immediately inward of said lid walls in said closed position, said lid walls defining corners complementary to the corners of said receptacle walls and aligned therewith.

12. The carton of claim 11 including a selectively releasable and reengageable lock assembly securing said lid to said receptacle in said closed position of said lid with said lid top panel peripherally seating on said upper edges of said receptacle walls.

13. The carton of claim 10 wherein said receptacle walls flare outwardly from said bottom panel with the upper edges thereof defining a periphery of equal size and shape, and co-extensive with the edges of said lid top panel for engagement of said upper edges of said receptacle walls at the juncture between said lid top panel and said lid walls, said lid walls defining corners directly aligning with and nesting with said corners formed by said receptacle walls to define braced column-like structures.

* * * * *

UNITED STATES PATENT AND TRADEMARK OFFICE

CERTIFICATE OF CORRECTION

PATENT NO. : 5,531,373

DATED : July 2, 1996

INVENTOR(S) : Eisman

It is certified that error appears in the above-indentified patent and that said Letters Patent is hereby corrected as shown below:

Column 10, line 28, after "wall" insert --side--.

Signed and Sealed this

Twenty-fourth Day of September, 1996

*Attest:*

Bruce Lehman

BRUCE LEHMAN

*Attesting Officer*

*Commissioner of Patents and Trademarks*